US006474421B1

(12) United States Patent
Stoesz

(10) Patent No.: US 6,474,421 B1
(45) Date of Patent: Nov. 5, 2002

(54) DOWNHOLE VIBRATOR

(75) Inventor: Carl W. Stoesz, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 35 days.

(21) Appl. No.: 09/585,240

(22) Filed: May 31, 2000

(51) Int. Cl.[7] ..... B25D 11/00
(52) U.S. Cl. ..... 173/91; 173/135; 175/296
(58) Field of Search ..... 173/19, 91, 135, 173/136; 175/296

(56) References Cited

U.S. PATENT DOCUMENTS

| | | | | |
|---|---|---|---|---|
| 3,946,819 A | | 3/1976 | Hipp | 175/296 |
| 4,462,471 A | | 7/1984 | Hipp | 175/296 |
| 4,958,691 A | | 9/1990 | Hipp | 175/296 |
| 5,049,084 A | | 9/1991 | Bakke | 439/66 |
| 5,156,223 A | * | 10/1992 | Hipp | 173/110 |
| 5,542,484 A | * | 8/1996 | McInnes | 173/73 |
| 5,595,244 A | * | 1/1997 | Roberts | 166/178 |
| 5,722,495 A | * | 3/1998 | Rear | 175/296 |
| 5,787,440 A | | 7/1998 | Bakke et al. | 707/103 |
| 5,787,982 A | | 8/1998 | Bakke | 166/242.6 |
| 5,803,182 A | | 9/1998 | Bakke | 173/91 |
| 6,016,498 A | | 1/2000 | Bakke et al. | 707/103 |

FOREIGN PATENT DOCUMENTS

| | | |
|---|---|---|
| GB | 2 329 408 A | 3/1999 |
| GB | 2 338 255 A | 12/1999 |
| WO | WO 97/29270 | 8/1997 |
| WO | WO 97/30262 | 8/1997 |
| WO | WO 97/46791 | 12/1997 |
| WO | WO 98/19041 | 5/1998 |

* cited by examiner

*Primary Examiner*—Scott A. Smith
*Assistant Examiner*—Chukwurah Nathaniel
(74) *Attorney, Agent, or Firm*—Gerald W. Spinks

(57) ABSTRACT

A vibratory impact tool for loosening downhole stuck objects in oil or gas wells, utilizing an internal piston spring which is repeatedly compressed by hydraulic pressure, and repeatedly released by lifting a dart valve from a valve seat on a flow-through piston. When the dart valve is lifted from the valve seat by a tripping spring, flow resumes through the piston, quickly lowering hydraulic pressure above the piston, allowing the piston spring to sharply drive the piston against the housing. The dart valve is then reseated on the valve seat, causing the piston to again be driven against the piston spring, rapidly repeating the process.

13 Claims, 2 Drawing Sheets

DOWNHOLE VIBRATOR

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention is in the field of downhole jarring devices used in oil and gas well drilling and downhole equipment recovery. More specifically, it is a device that imparts rapid impacts to the desired portion of the work string or a stuck object, often referred to as a "fish", for the purpose of loosening the stuck object.

2. Background Art

In well operation, there is often a need for jarring, impact or vibration devices to move downhole stuck members. Jars are typically included in a pipe or work string to provide upward or downward impacts when activated. Jars are usually single impact devices which must be recocked each time before operation, limiting the number of impacts per minute, and therefore limiting the energy, that can be delivered to a stuck member.

Some known impact tools require the operator to pull up on the work string with a force sufficient to pre-stress the work string, thereby providing the motive force for an impact. The impact is typically initiated when some type of valve or other triggering device in the tool triggers an action which applies the energy stored in the pre-stressed work string in the form of an impact delivered to the stuck object. The force of the impact delivered by such a tool depends upon how much energy is stored in the pre-stressed work string. That is, a larger over-pull will deliver a harder blow to the stuck object.

Often, in the use of this type of tool, the weight of the fish itself can be significant enough to raise the tension in the work string to such a high level that the tool will cease to function. More specifically, the force which can be applied to the triggering device by the flow of fluid is limited by the available fluid flow rate. The higher the amount of pre-stress tension, the harder it is to make the tool function. If the weight of the fish is too close to the pre-stress limit of the tool, the tool will cease to function as the fish begins to loosen. The operator then has to reduce the pre-stress on the work string to make the tool resume functioning, thereby limiting the force available in each impact and making the tool less effective.

Further, a tool which relies on work string pre-stress often has a fluid flow path which allows well bore return fluid to enter the tool, which exposes the internal tool parts to well bore debris. This can clog or restrict the moving parts and render the tool inoperative, it can cause failure of the seals, or it can cause the tool to wear out prematurely.

BRIEF SUMMARY OF THE INVENTION

The device of the present invention uses hydraulic power from surface pumps to repeatedly compress an internal piston spring in the tool. The piston spring is repeatedly allowed to expand, to deliver continuous rapid impacts. The sustained energy that is delivered to the stuck member becomes a motivating force to free the stuck member. When the operator desires, the fluid flow rate through the tool is increased to a selected level, which will exert sufficient hydraulic pressure to move a dart valve to seal against a valve seat on a flow-through piston. This cuts off flow through the piston and drives the piston and the dart valve downwardly. As the piston moves downwardly, it compresses the piston spring. At a designed tripping point, the dart valve is lifted away from the valve seat on the piston by a tripping spring, allowing flow through the piston to resume, sharply decreasing the hydraulic pressure on the piston. This allows the piston spring to drive the piston sharply upward, delivering an impact to the tool housing. Movement of the dart valve away from the piston seat is arrested by a momentary increase in hydraulic pressure above the dart valve, caused by a momentary cutoff of fluid flow through the dart valve. The dart valve is then driven downwardly again, and the cycle repeats rapidly.

The motive force for the impact is generated entirely within the tool, eliminating any need for prestressing the tool from above. This allows the tool to function regardless of the weight of the stuck object. No return fluid flow passes through the tool, eliminating the danger of contamination by well debris.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
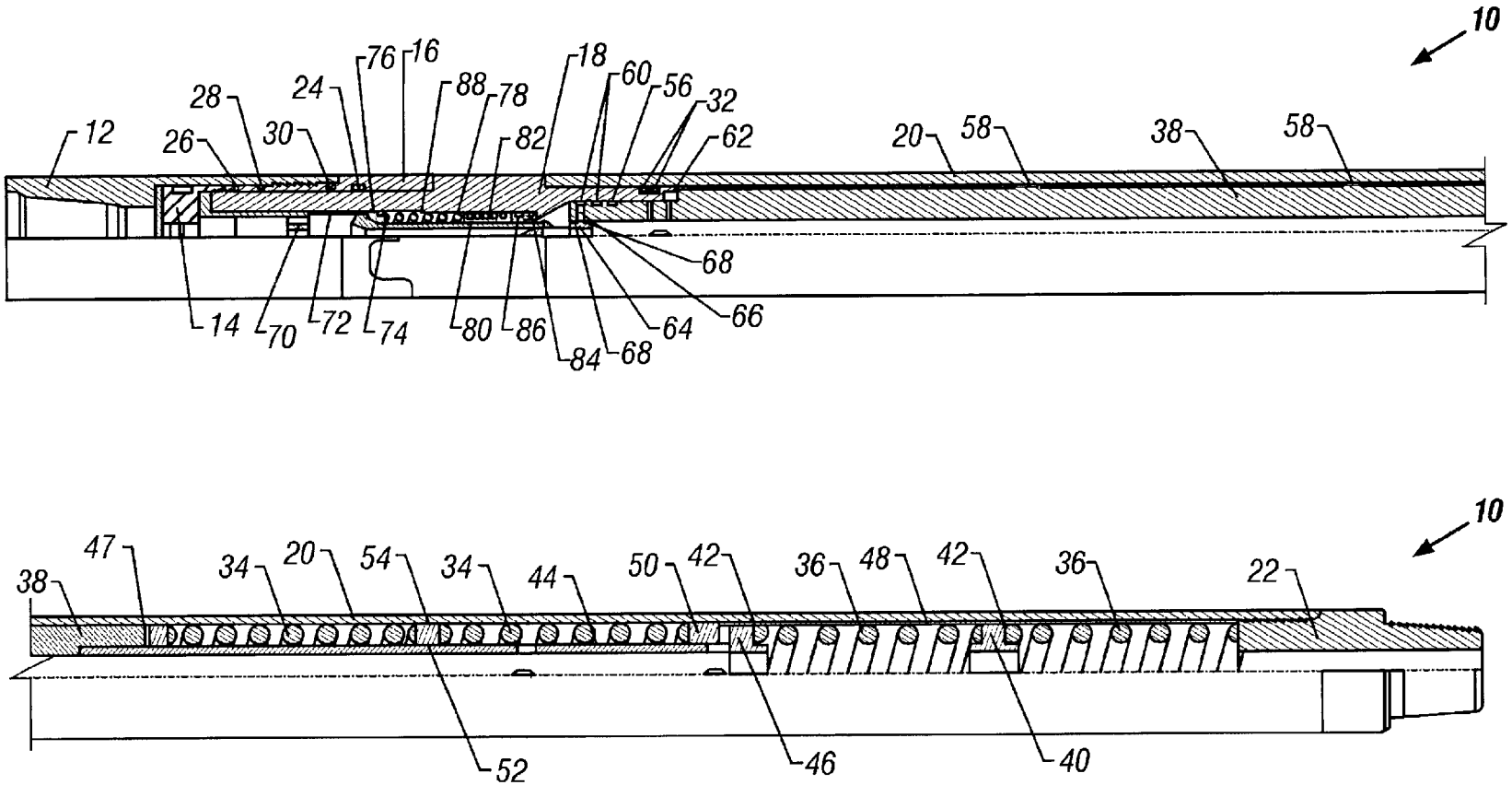
FIG. 1 is a longitudinal quarter section view of the tool of the present invention.

The vibratory tool 10 of the present invention is shown in quarter section in FIG. 1. It is comprised of an outer housing assembly made up of a top sub 12, a shoulder stop 14, a clutch 16, a clutch housing 18, a piston housing 20, and a bottom sub 22. The outer housing assembly provides means of transmitting tension and torque through the tool 10. As tension is applied at the top sub 12, it is transmitted to the clutch 16 through connecting threads. The clutch 16 is free to travel axially on the clutch housing 18. The clutch 16 contains one or more seals 24 which prevent communication of fluid from the interior of the tool 10 to the exterior of the tool 10 during axial movement of the clutch 16. Upward axial travel of the clutch 16 is limited by shouldering up against the shoulder stop 14, which is threaded tightly against the clutch housing 18. The shoulder stop 14 is prevented from backing off during operation of the tool 10 by one or more set screws 26. Axial tension is passed from the clutch 16, through the shoulder stop 14, then to the clutch housing 18, the piston housing 20, and the bottom sub 22.

Torque applied through the top sub 12 is transmitted through threads to the clutch 16. The clutch 16 transmits torque to the clutch housing 18 through meshed fingers on both the clutch 16 and the clutch housing 18. Torque is transmitted from the clutch housing 18 to the piston housing 20 and the bottom sub 22 via threaded connections. The outer housing assembly is sealed by a plurality of seals 24, 28, 30, and 32.

The fingered slip joint between the clutch 16 and the clutch housing 18 isolates the top sub 12 and the shoulder stop 14 from longitudinal impacts traveling upward through the clutch housing 18, and reflects longitudinal shock waves back down through the clutch housing 18, the piston housing 20, and the bottom sub 22, to the lower portion of the string or to the fish, not shown.

One or more upper and lower piston springs 34, 36 bias a piston 38 upwardly. The upper and lower piston springs 34, 36 are initially preloaded to give a selected upward biasing force against the piston 38. The two lower piston springs 36 are separated by a lower piston spring retainer 40, containing a wear guide 42. The spring force from the lower piston springs 36 is transmitted to a mandrel 44 through a lower piston spring stop 46, containing another wear guide 42. The mandrel 44 is threaded into the bottom portion of the piston 38 to transmit the spring force from the lower piston springs 36 to the piston 38. The mandrel 44 also serves as a guide to the upper piston springs 34. One or more set screws 47 serve to help retain the mandrel 44 to the piston 38.

A sleeve 48 and an upper piston spring stop 50 act to isolate the spring forces of the upper piston springs 34, so they can transmit spring forces directly to the piston 38, independently of the lower piston springs 36. The two upper piston springs 34 are separated by an upper piston spring retainer 52, containing a wear guide 54. The piston 38 is free to move axially inside the piston housing 20 and the clutch housing 18. The piston 38 is centralized by at least two wear guides 56, 58. Piston rings 60 provide dynamic sealing between the piston 38 and the clutch housing 18.

An impact ring 62 separates the piston 38 from the clutch housing 18 and restricts the upward axial movement of the piston 38. Importantly, when the piston 38 moves upwardly, the impact ring 62 also distributes impact forces from the piston 38 to the clutch housing 18.

The piston 38 is hollow, to allow fluid flow therethrough. Contained within the upper end of the piston 38 is an annular valve seat 64. The valve seat 64 is retained to the piston 38 by at least one set screw 66 which lies beneath the upper piston ring 60, to prevent backing off of the set screws 66. The valve seat 64 is sealed inside the piston 38 by two seals 68.

Inside the clutch housing 18 is a dart valve mechanism comprising a sleeve retainer 70, a dart valve sleeve 72, and a dart valve body 74. The sleeve retainer 70 has holes therethrough, and the dart valve body 74 is hollow, to allow fluid flow therethrough. Surrounding the dart valve body 74 is a valve spring assembly made up of a spring stop 76, a valve trip spring 78, a standoff sleeve 80, a standoff spring 82, and a dart valve guide 84. The dart valve guide 84 is held in place by an o-ring 86. The spacing of the valve spring assembly is such that the valve spring assembly and the dart valve body 74 are free to travel axially.

The standoff spring 82 is weaker than the valve trip spring 78, and the standoff spring 82 is spaced so that the dart valve body 74, the spring stop 76, and the valve trip spring 78 can be allowed an initial shift in the downward axial direction without compressing the valve trip spring 78. This initial downward shift allows the dart valve body 74 to seal against the valve seat 64 in the upper end of the piston 38, stopping fluid flow through the piston 38. The standoff sleeve 80 prevents overtravel of the valve spring assembly in the downward axial direction. Upward movement of the valve spring assembly is stopped by abutment of the spring stop 76 against the dart valve sleeve 72. The dart valve body 74 is concentrically located within the valve spring assembly, the standoff sleeve 80, and the dart valve guide 84.

After the standoff sleeve 80 contacts the dart valve guide 84, a shoulder on the upper end of the dart valve body 74 seats against the spring stop 76, so that as the dart valve body 74 travels downwardly, the valve trip spring 78 is compressed. Downward axial travel of the dart valve body 74 is limited by abutment of the spring stop 76 with an annular internal shoulder 88 on the clutch housing 18.

Figure 2:
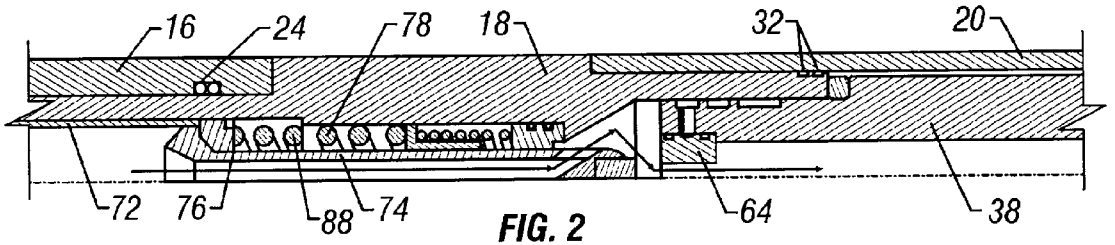
FIG. 2 is a partial section view of the tool shown in FIG. 1, prior to movement of the dart valve.
Figure 3:
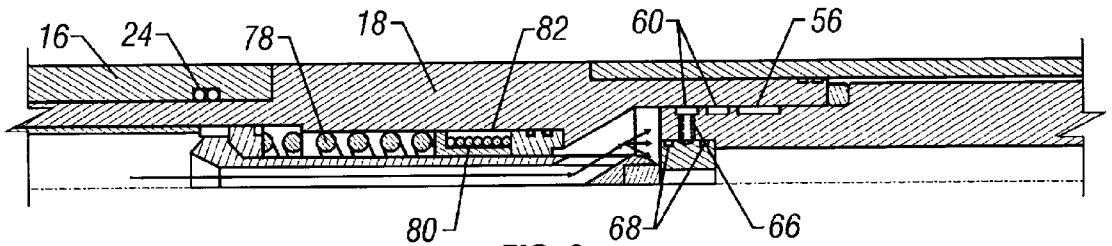
FIG. 3 is a partial section view of the tool shown in FIG. 1, after movement of the dart valve to seal against the valve seat on the piston.

Operation of the tool 10 is illustrated in FIGS. 2 through 5. FIG. 2 shows a close up of the tool 10 in the configuration in which it is run into the well bore. The standoff spring 82 provides an initial biasing of the dart valve body 74 toward an open position, spacing the dart valve body 74 away from the piston valve seat 64, allowing flow through the tool. When the fluid flow rate is selectively increased by the operator to a critical flow rate, the increased fluid resistance of the dart valve body 74 causes the dart valve body 74 to move downwardly, compressing the standoff spring 82, until the standoff sleeve 80 contacts the dart valve guide 84, and the dart valve body 74 comes into contact with the valve seat 64, as shown in FIG. 3. At this point, the fluid flow through the tool 10 is shut off, and pressure begins to build against the upper end of the piston 38 and the dart valve body 74.

Figure 4:
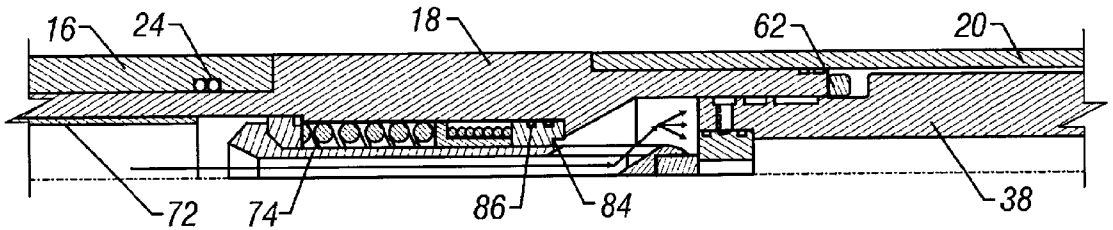
FIG. 4 is a partial section view of the tool shown in FIG. 1, after further downward movement of the dart valve and the piston to compress the dart valve spring and the piston spring.
Figure 5:
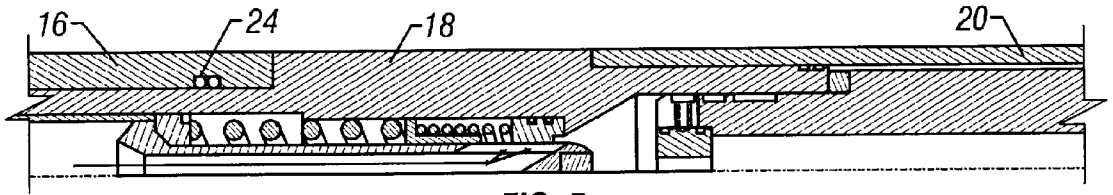
FIG. 5 is a partial section view of the tool shown in FIG. 1, after separation of the dart valve from the valve seat, and after upward movement of the piston to impact the housing.

This increased fluid pressure pushes the piston 38 downwardly, compressing the upper and lower piston springs 34, 36, as shown in FIG. 4. As the dart valve body 74 moves downwardly with the piston 38, the dart valve trip spring 78 is also compressed, providing an increasing upward force against the dart valve body 74. At the point where the downward hydraulic pressure force on the dart valve body 74 equals the upward force created by the dart valve trip spring 78, the dart valve body 74 separates from the valve seat 64, and the valve spring assembly suddenly retracts away from the piston 38, as shown in FIG. 5.

The upward momentum of the valve spring assembly and the dart valve body 74 is used to temporarily shut off fluid flow through the dart valve body 74, to stop the valve spring assembly and the dart valve body 74 from overtravel in the upward direction. This is accomplished by restricting the fluid that can bypass the valve spring assembly. As the dart valve body 74 moves upwardly, the flow passage through the dart valve body 74 is gradually restricted as the flow path through the outside diameter of the dart valve body 74 is shut off by the inner diameter of the dart valve guide 84. As the flow becomes restricted, pressure is built up above the dart valve body 74, slowing the dart valve body 74, the dart valve trip spring 78, the standoff sleeve 80, and the standoff spring 82, until the upward travel of the dart valve body 74 and the valve spring assembly is halted. The pressure then returns the dart valve body 74 and the valve spring assembly to its operating position.

As the dart valve body 74 moves upwardly, the seal between the dart valve body 74 and the valve seat 64 is lost, causing a rapid drop in pressure above the piston 38. Since the downward hydraulic pressure force is lost, the upper and lower piston springs 34, 36 cause the piston 38 to rapidly return and strike against the impact ring 62, causing a sharp upward impact to be delivered to the clutch housing 18, as shown in FIG. 5. The dart valve body 74 then reseats on the valve seat 64, and the entire cycle repeats numerous times each second. This process continues for as long as a sufficiently high rate of fluid flow is maintained through the tool 10 by the operator.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

I claim:

1. A downhole oil and gas well vibratory impact tool, comprising:

a housing adapted for connection in a work string;

a piston mounted within said housing;

a biasing device within said housing urging said piston to move in a longitudinal bias direction within said housing;

a fluid flow path through said housing;

a valve body in said fluid flow path, said valve body being movable toward a modulation position upon increased fluid flow, wherein movement of said valve body toward said modulation position decreases said fluid flow and increases fluid pressure urging said piston to move in a direction opposite to said bias direction, thereby storing impact energy in said biasing device; and a tripping device within said housing urging said valve body away from said modulation position, wherein movement of said valve body away from said modulation position decreases said fluid pressure on said piston, thereby allowing said biasing device to move said piston in said bias direction to deliver said impact energy to said housing.

2. The impact tool recited in claim 1, wherein said biasing device comprises a piston spring within said housing applying spring force to urge said piston toward impact with said housing.

3. The impact tool recited in claim 2, wherein said piston spring is arranged with a first end abutting said housing and a second end abutting said piston.

4. The impact tool recited in claim 1, wherein:

said tripping device comprises a second biasing device urging said valve body away from said modulation position;

said modulation position of said valve body is a position occluding said fluid flow path, wherein static fluid pressure is applied to move said piston in said direction opposite to said bias direction; and said second biasing device overcomes said fluid pressure at a tripping position of said valve body, thereby urging said valve body away from said occluding position to allow fluid flow to resume, decreasing said fluid pressure on said piston.

5. The impact tool recited in claim 4, wherein:

said fluid flow path passes through said piston;

said second biasing device comprises a valve spring applying spring force to urge said valve body away from said piston;

said valve body is moved by increased fluid flow to compress said valve spring and forcefully abut said piston, thereby occluding said fluid flow path; and at said tripping position of said valve body, said spring force generated by said valve spring counteracts force generated by said fluid pressure on said valve body, thereby reducing said forceful abutment of said valve body with said piston, allowing fluid flow to resume, thereby decreasing said fluid pressure on said piston.

6. The impact tool recited in claim 5, wherein said valve spring is arranged with a first end abutting said housing and a second end abutting said valve body.

7. The impact tool recited in claim 1, wherein:

said tripping device urges said valve body to move against said fluid flow; and said valve body generates sufficient fluid flow resistance to arrest said movement away from said modulation position, after activation of said tripping device.

8. A downhole oil and gas well vibratory impact tool, comprising:

a housing adapted for connection in a work string;

a piston mounted within said housing;

a piston spring within said housing urging said piston in a longitudinal direction toward impact with said housing;

a fluid flow path through said housing and through said piston;

a valve body in said fluid flow path, said valve body being movable by fluid pressure to a position abutting said piston and occluding said fluid flow path, wherein static fluid pressure is applied to move said piston in a direction opposite to said bias direction, thereby storing impact energy in said piston spring; and a valve spring within said housing, said valve spring applying spring force to urge said valve body away from said piston, said spring force generated by said valve spring at a tripping position of said valve body counteracts force generated by said fluid pressure on said valve body, thereby reducing said abutment of said valve body with said piston and allowing fluid flow to resume;

wherein resumption of fluid flow in said flow path decreases said fluid pressure on said piston, thereby allowing said piston spring to move said piston in said bias direction to deliver said impact energy to said housing.

9. A downhole oil and gas well vibratory impact tool, comprising:

a housing adapted for connection in a work string;

a piston mounted within said housing;

a biasing device within said housing urging said piston upwardly relative to said housing;

a fluid flow path through said housing;

a valve body in said fluid flow path, said valve body being movable toward a modulation position upon increased fluid flow, wherein movement of said valve body toward said modulation position decreases said fluid flow and increases fluid pressure urging said piston to move downwardly, thereby storing impact energy in said biasing device; and a tripping device within said housing urging said valve body away from said modulation position, wherein movement of said valve body away from said modulation position decreases said fluid pressure on said piston, thereby allowing said biasing device to move said piston upwardly to deliver said impact energy to said housing.

10. The impact tool recited in claim 9, wherein said biasing device comprises a piston spring within said housing applying upward spring force to urge said piston toward impact with said housing.

11. The impact tool recited in claim 10, wherein said piston spring is arranged with a lower end abutting said housing and an upper end abutting said piston.

12. The impact tool recited in claim 9, wherein:

said tripping device comprises a second biasing device urging said valve body away from said modulation position;

said modulation position of said valve body is a position occluding said fluid flow path, wherein static fluid pressure is applied to move said piston downwardly; and said second biasing device overcomes said fluid pressure at a tripping position of said valve body, thereby urging said valve body away from said occluding position to allow fluid flow to resume, decreasing said downward fluid pressure on said piston.

13. The impact tool recited in claim 12, wherein:

said fluid flow path passes through said piston;

said second biasing device comprises a valve spring applying spring force to urge said valve body upwardly;

said valve body is moved downwardly by increased fluid flow to compress said valve spring and forcefully abut said piston, thereby occluding said fluid flow path; and at said tripping position of said valve body, said upward spring force generated by said valve spring counteracts downward force generated by said fluid pressure on said valve body, thereby reducing said forceful abutment of said valve body with said piston, allowing fluid flow to resume, thereby decreasing said downward fluid pressure on said piston.

* * * * *